US007048093B2

(12) United States Patent
Wallther

(10) Patent No.: US 7,048,093 B2
(45) Date of Patent: May 23, 2006

(54) COUPLING DEVICE FOR SCAFFOLDINGS

(75) Inventor: Harry Wallther, Hindås (SE)

(73) Assignee: Pluseight Technology AB (SE)

( * ) Notice: Subject to any disclaimer, the term of this patent is extended or adjusted under 35 U.S.C. 154(b) by 0 days.

(21) Appl. No.: 10/363,951

(22) PCT Filed: Sep. 6, 2001

(86) PCT No.: PCT/SE01/01904

§ 371 (c)(1),
(2), (4) Date: Sep. 2, 2003

(87) PCT Pub. No.: WO02/22989

PCT Pub. Date: Mar. 21, 2002

(65) Prior Publication Data

US 2004/0211624 A1 Oct. 28, 2004

(30) Foreign Application Priority Data

Sep. 6, 2000 (SE) ..... 0003133

(51) Int. Cl.
*E04G 7/00* (2006.01)

(52) U.S. Cl. ..... 182/186.7; 403/49

(58) Field of Classification Search ..... 182/186.8, 182/186.7, 178.1, 179.1, 119, 222; 403/49, 403/170, 374.1; 211/191, 192
See application file for complete search history.

(56) References Cited

U.S. PATENT DOCUMENTS

| | | | | |
|---|---|---|---|---|
| 2,060,171 | A * | 11/1936 | Burton | 403/53 |
| 2,240,864 | A * | 5/1941 | Segre | 403/391 |
| 2,674,476 | A * | 4/1954 | Del Grosso | 403/49 |
| 2,853,324 | A * | 9/1958 | Neidmann | 403/385 |
| 4,039,264 | A * | 8/1977 | Sharp | 403/246 |
| 4,095,910 | A * | 6/1978 | Steele et al. | 403/49 |
| 4,273,463 | A * | 6/1981 | Dobersch | 403/246 |
| 4,405,254 | A * | 9/1983 | Tooley | 403/246 |
| 4,439,052 | A * | 3/1984 | Wallther | 403/49 |
| 4,586,842 | A * | 5/1986 | Puccinelli | 403/246 |
| 5,078,532 | A * | 1/1992 | Williams | 403/246 |
| 5,127,757 | A * | 7/1992 | Langer | 403/49 |
| 5,186,568 | A * | 2/1993 | Falardeau | 403/49 |
| 5,207,527 | A * | 5/1993 | Duncan et al. | 403/246 |
| 5,217,314 | A * | 6/1993 | Perruelle | 403/49 |
| 5,615,966 | A * | 4/1997 | Jarvis et al. | 403/49 |
| 5,961,240 | A * | 10/1999 | Bobrovniczky | 403/49 |
| 5,988,318 | A * | 11/1999 | Krause | 182/222 |
| 6,027,276 | A * | 2/2000 | Schworer | 403/49 |
| 6,220,392 | B1 * | 4/2001 | Schwoerer | 182/186.8 |

FOREIGN PATENT DOCUMENTS

| | | |
|---|---|---|
| CA | 1194059 A1 | 9/1985 |
| CH | 660 617 A1 | 5/1987 |
| DE | 33 45 645 A1 | 7/1985 |
| DE | 42 42 031 A1 | 6/1994 |
| FR | 2 680 196 A1 | 2/1993 |
| SE | 7908679-9 B1 | 5/1982 |

* cited by examiner

*Primary Examiner*—Alvin Chin-Shue
(74) *Attorney, Agent, or Firm*—Lerner, David, Littenberg, Krumholz & Mentlik, LLP

(57) ABSTRACT

A coupling device including a first tightening part and a second tightening part. The first tightening part includes a tightening surface and is moveable about a pivot axis. The second tightening part is also moveable about the pivot axis. The first tightening part and the second tightening part are translatable between a release position and a lock position, such that after said first tightening part is moveable about the pivot axis and into the locked position, the second tightening part is moveable about the pivot axis into said lock position.

16 Claims, 11 Drawing Sheets

COUPLING DEVICE FOR SCAFFOLDINGS

TECHNICAL FIELD OF THE INVENTION

The present invention relates to a device for coupling scaffolding elements to uprights in a scaffold according to the preamble of appended claim 1.

PRIOR ART

By for example SE-B-7908679-9, a coupling device is previously known with a locking device in the form of two tightening parts, one of it which consists of a locking wedge. The handling of the two tightening parts needs to be done in several steps since the locking device does not have a stable release position.

SUMMARY OF THE INVENTION

The purpose of the present invention is thus to arrive at a coupling device with a locking device, which can, in a simple manner, be switched between a release position and a locking position. The said purpose is obtained by means of a device-according to the present invention, the characteristics of which will become apparent by appended claim 1.

DESCRIPTION OF THE DRAWINGS

The invention will be described in more detail in the following by means of some embodiments with reference to the appended drawings.

FIGS. 9 and 10 are a view of the device in the release position from either side while

PREFERRED EMBODIMENT

Figure 1:
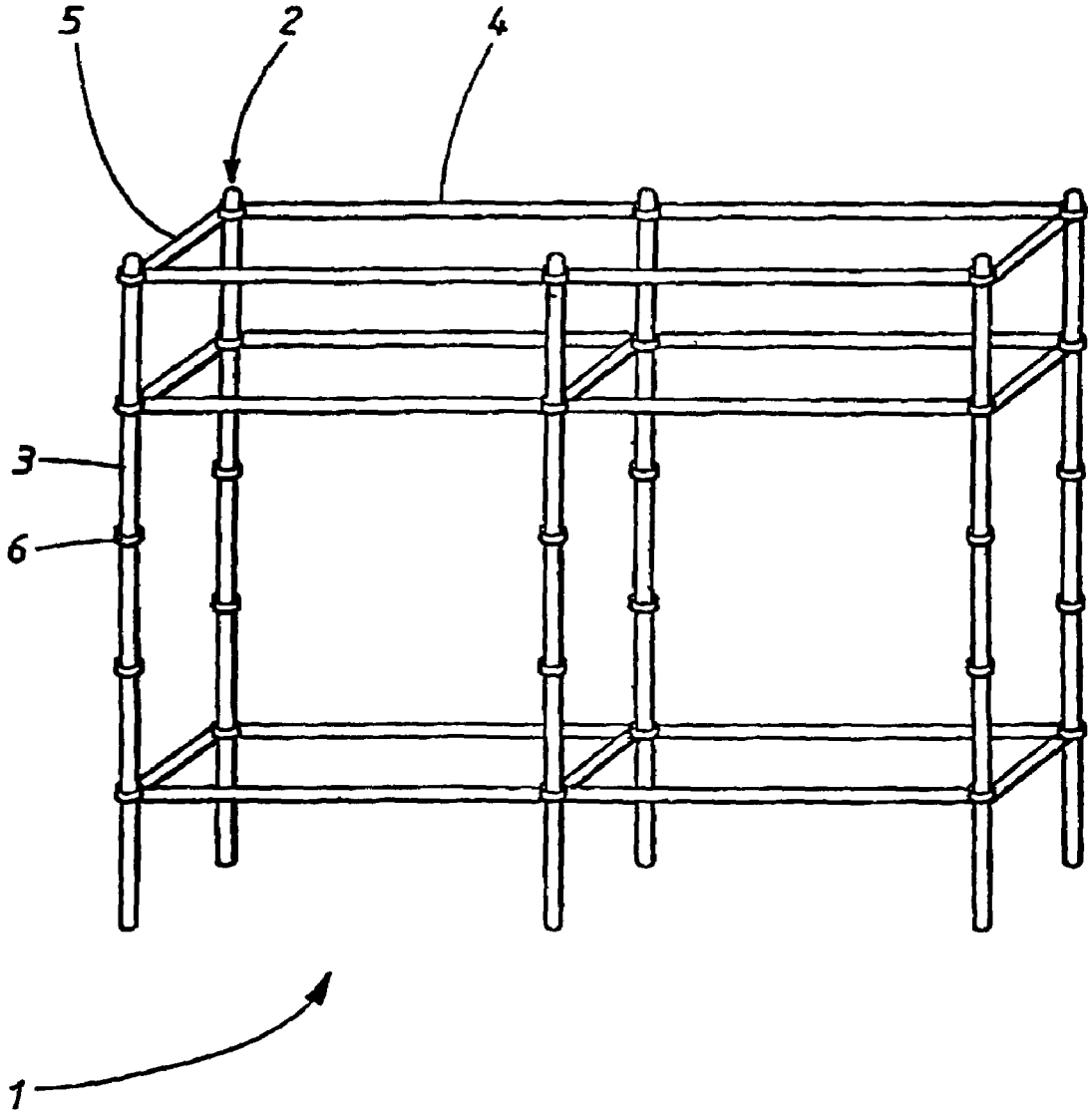
FIG. 1 shows an example of a simple scaffolding at which the present invention can be applied.

FIG. 1 shows an example of a scaffolding 1, which is equipped with coupling devices 2 which can be of the type provided by the invention. The scaffolding consists of a number of uprights 3, which at their lower end rests on a surface which can be the ground, a sidewalk, a floor or the like. In the scaffolding is comprised, except for the uprights, another type of scaffolding elements, a number of horizontal scaffolding elements 4, 5 which, for example, by means of the coupling devices 2 according to the invention are coupled to the uprights. Since the horizontal scaffolding elements at their both ends are coupled to the uprights, the horizontal scaffolding elements are supported by means of the coupling. The coupling device according to the invention is an extremely rigid coupling, which means that the scaffolding can stand alone, but in a traditional application when positioned at a building, it is usually fastened to the building for safety reasons. The traditional scaffolding has as its object to support not shown building platforms, which usually rest between the horizontal coupling elements 5, but the scaffolding can have a number of various applications and functions, such as, for example, forming a stage, scaffolding at various events, to support weather shelters for people, vehicles, boats, buildings, to support signs or to form a so-called brace to support cast constructions during building. As will become evident from FIG. 1, the uprights 3 exhibit a number of gripping parts 6 arranged over the length of the uprights at different levels and being part of the coupling devices 2 in order to enable the coupling of the scaffolding elements 4, 5 at various levels. Apart from the horizontal elongate scaffolding elements 4, 5 which form a supporting part of the scaffolding as a whole, it is possible that the coupling device 2 according to the invention is used for the suspension of special scaffolding elements for special purposes, for example for anchoring lifting devices or other aids for carrying out a specific kind of work. In such cases, such scaffolding elements do not need to be elongated or horizontal, and can in certain cases be retained at a single upright, and be coupled to one or more gripping parts. The scaffolding elements can, alternatively, consist of so-called lattice rails, which form rails and protection from falling. Several horizontal scaffolding elements 4, 5 can be coupled to one upright by means of one and the same coupling device.

The construction of the coupling device 2 will first be described with reference to FIGS. 2–5. The coupling device consists, apart from a first coupling part which consists of the gripping part 6, of a second coupling part which consists of a hook-shaped part 7 which is fixedly attached to each end 8, or in special applications to one end of the horizontal scaffolding elements 4. The gripping part 6 in the first embodiment consist of a bowl-shaped unit which by means of, for example a welding, is fixedly attached to the upright 3, in more detail to its enveloping surface 9, which in the example shown is cylinder-shaped, but in principle can be of a shape with corners, for example a square pipe, or in principle a massive rod. In the example shown, the gripping part 6 exhibits a wall 10 which extends around the enveloping surface of the upright, with a first gripping surface 11 facing inwards towards the upright which extends concentrically with the upright, i.e. with a constant distance around the upright from the enveloping surface 9 of the upright. The gripping part 6 exhibits a bottom 12 which advantageously exhibits not shown drainage holes for water, particles and the like. In principle, the bowl-shape can be replaced by the cylindrical wall 10 alone which is connected to the enveloping surface 9 of the upright by means of stress absorbing distance elements. The gripping part 6, regardless of its shape, forms a space 35 positioned between the gripping surface 11 and the enveloping surface 9 of the upright.

The hook-shaped part 7 is arranged to, when the coupling device is assembled, protrude into the space 35 of the gripping part 6 in order to engage it and be supported by it. As can best be seen from FIG. 4, the gripping surface 11 consists of a first gripping surface which is intended to interact with a second gripping surface 29 on the hook-shaped part 7, which second gripping surface faces away from the upright 3 and towards the gripping surface 11 of the gripping part 6, i.e. the first gripping surface. Although this cannot be clearly seen, the second gripping surface 29 is also advantageously curved, in more detail it is convexly curled with essentially the same shape as the gripping surface 11 of the gripping part, by means of which surface contact is assured. The gripping part exhibits an upwardly facing resting surface 33 which is formed by the ring-shaped, in the example shown circular, edge of the wall 10. This forms a first resting area in the coupling device, which area is arranged to interact with a downwardly facing similarly shaped resting area 34 of the hook-shaped part 7. The resting areas 33, 34 are advantageously plane, and in the example extend in a radial plane relative to the longitudinal axis 30 of the upright 3.

Figure 2:
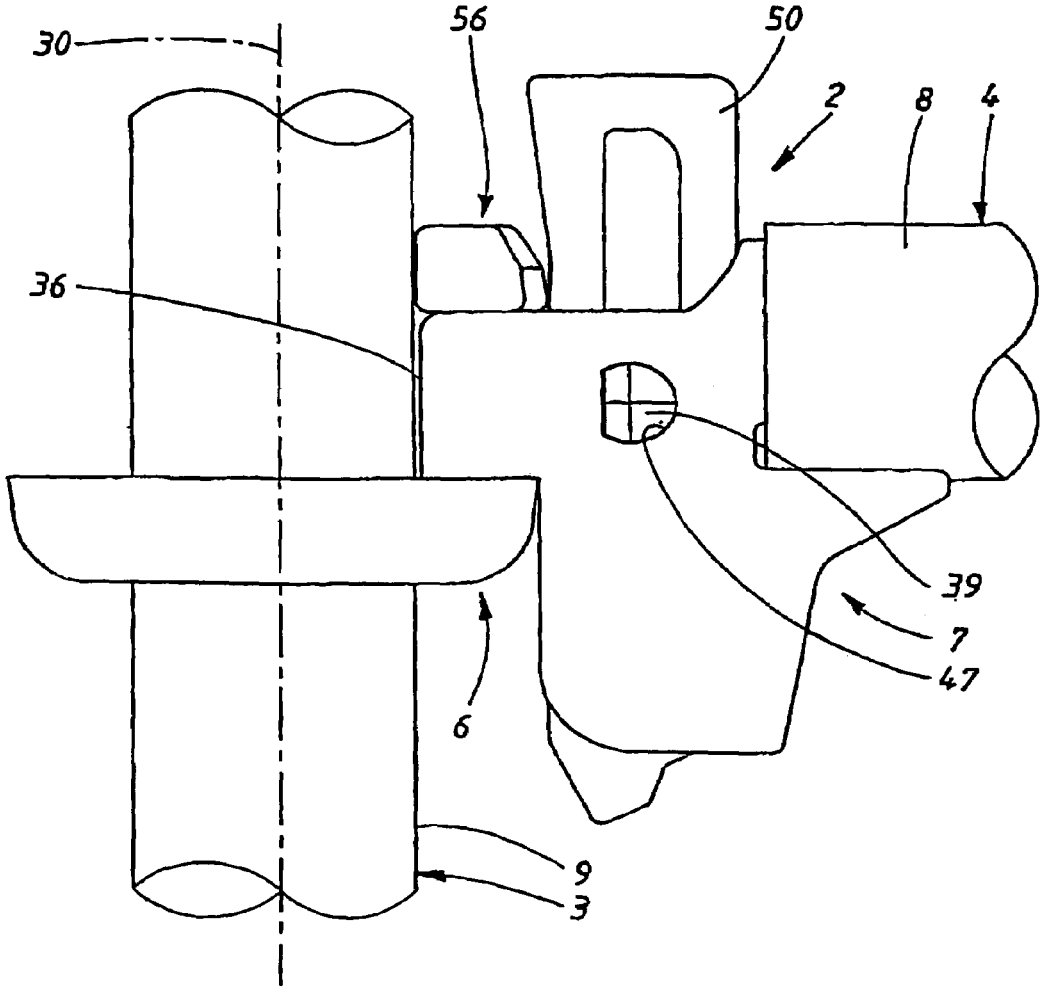
FIG. 2 is a side view of a coupling device according to the invention in the release position.
Figure 3:
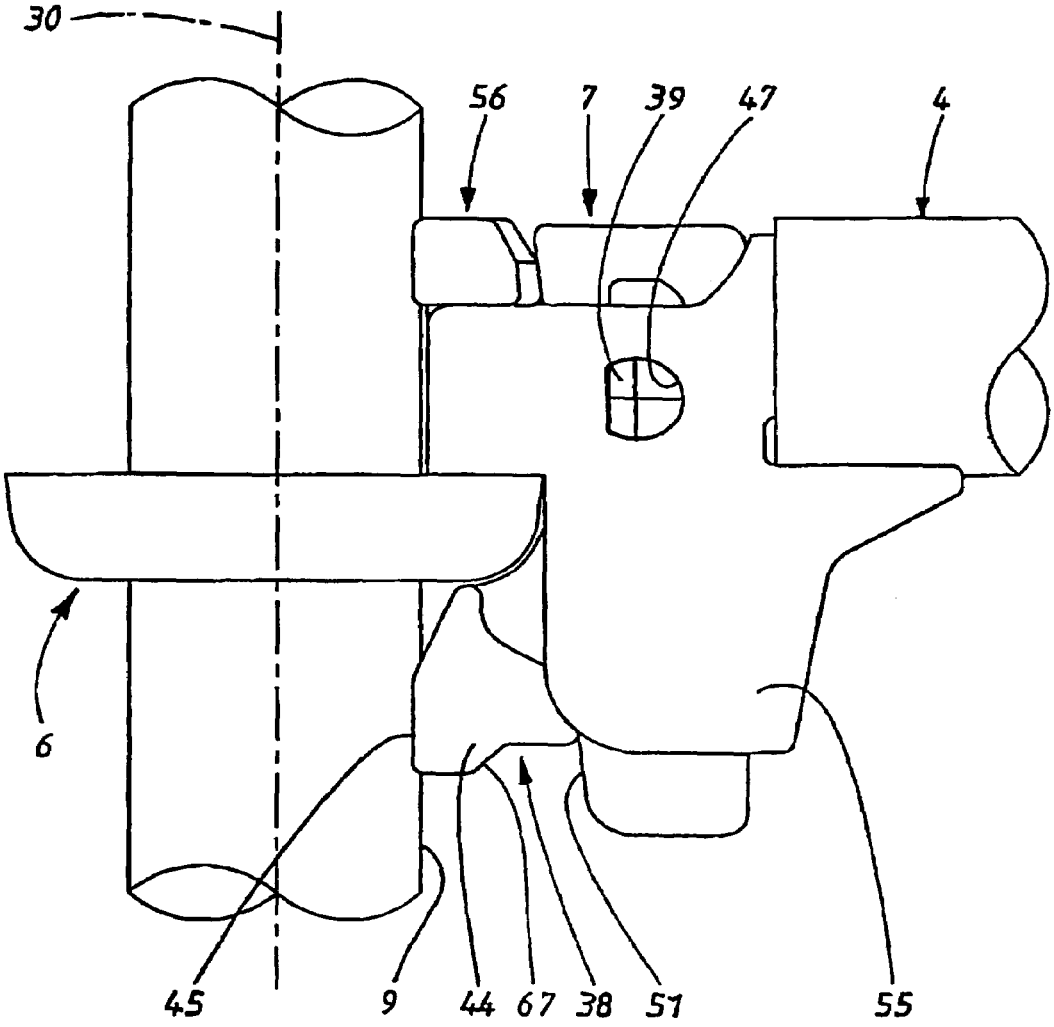
FIG. 3 is a side view of the device according to FIG. 2 with the device in the locking position.

As can be seen from FIG. 2, the enveloping surface 9 of the upright 3 forms a position limit radially inwards for the hook-shaped part 7 in interaction with the radially inwards towards the upright facing end surface 36 of the hook-shaped part. For reasons of tolerances, however, the hook-shaped part 7 is dimensioned so that its radial dimensions in that part of it that protrudes downwards into the gripping part 6 are always smaller than the radial dimension of the space 35.

Figure 4:
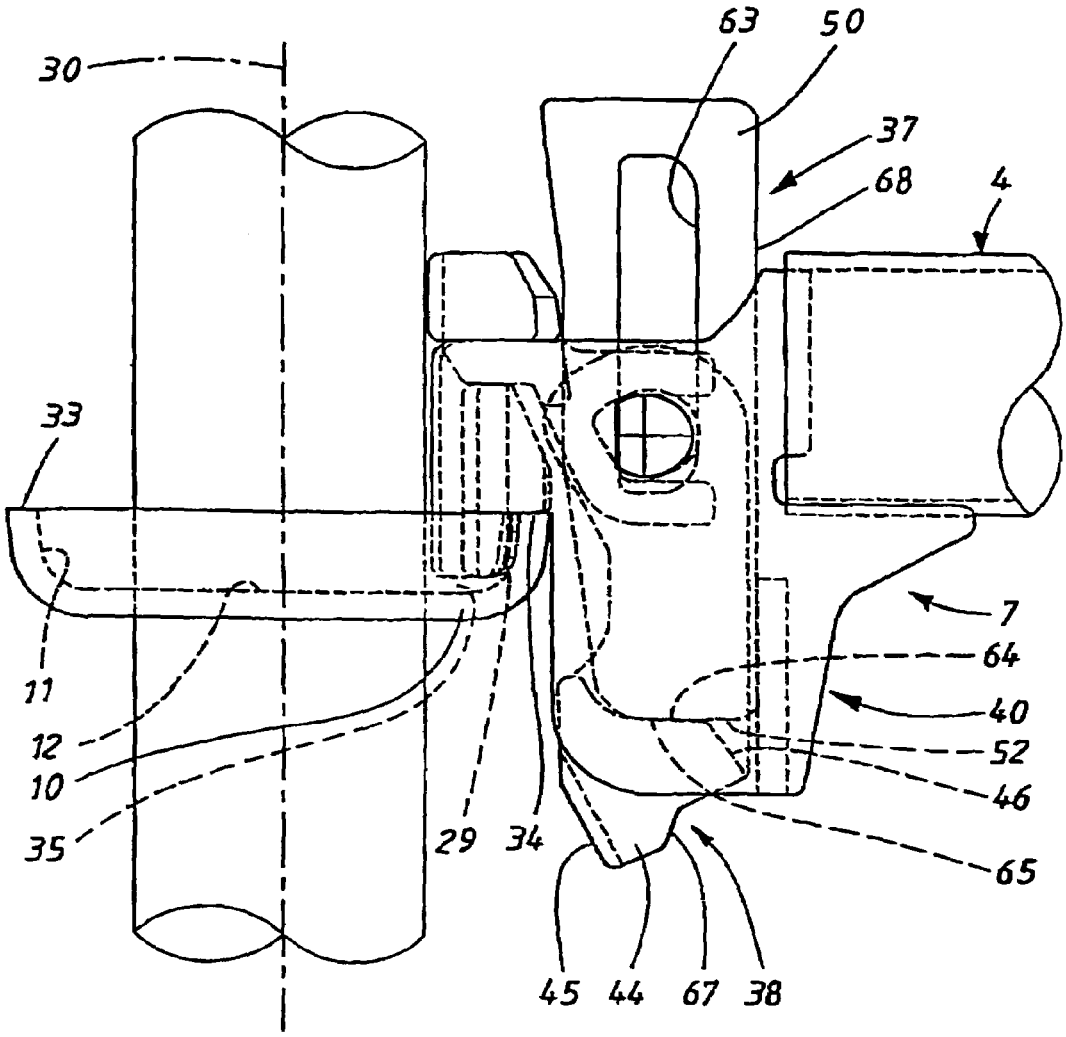
FIGS. 4 and 5 show views which correspond to FIG. 1 and 2 but with hidden lines added.
Figure 5:
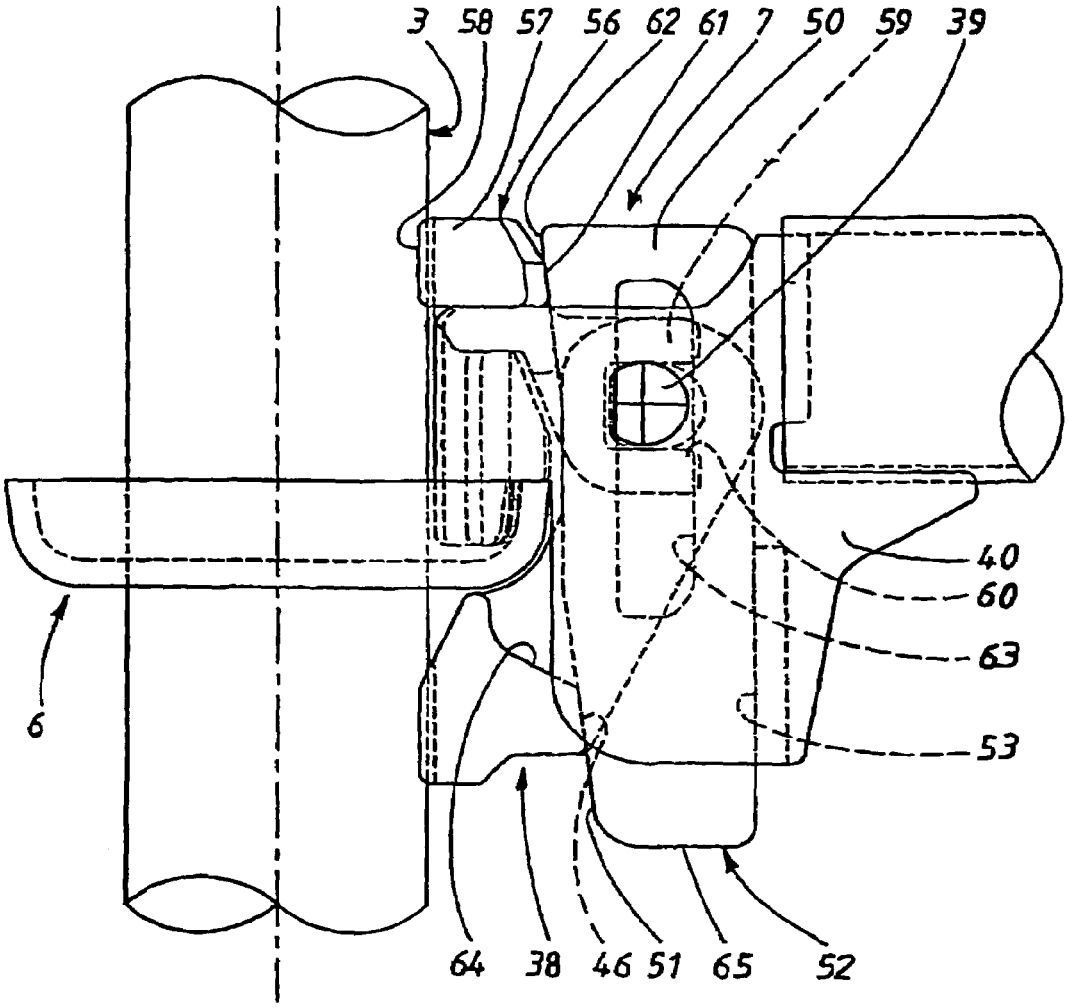

However, this radial difference in the embodiments described above should be less than the radial width of the downwards facing resting surface 34 of the hook-shaped part 7 so that it cannot glide inside of the upwards facing resting area 33 of the gripping part 6 in a coupled, i.e. hooked but not locked position according to FIGS. 2 and 4.

In the coupling device, a locking device 37 is comprised which in FIGS. 2, 4, 9, 10 is shown in a non-locking position, and in FIGS. 3, 5, 7, 8 in the locking position. The locking device exhibits a first tightening part 38 which in the example shown is rotationally connected by means of an axis 39, with a fixed locking body 40 which is integrated with the hook-shaped part 7, and is fixed in the scaffolding element 4. In more detail, there is in the locking body 40 arranged a through-going cavity 41 which extends from the top and downwards in whose opposite walls 42, 43 the axis 39 is arranged. The axis 39 consists of an axis pin which extends across through the cavity 41. The tightening part 38 exhibits a forwardly facing tightening surface 45 in a lower and slightly protruding portion 44. The direction forward in this case refers to a direction towards the upright, and backwards refers to the opposite direction.

The tightening part 38 furthermore exhibits a rearwardly facing tightening surface 46 which faces away from the forwardly facing tightening surface, and is also arranged at the lower protruding portion 44 at a distance from the joint of the tightening part, i.e. its axis 39, which thus extends between the two side walls 42, 43 and, in the example shown, also through these in a bore 47. The tightening part 38 exhibits a longitudinal portion 48, which on its upper side exhibits a hole 49 through which the transverse axis 39 extends.

In the through-going cavity 41, a second tightening part 50 is arranged, and forms a locking wedge by exhibiting a downwardly facing wedge-shaped decreasing dimension seen in the radial direction of the upright 3. This second tightening part 50 exhibits an angled forward tightening surface 51, which in the direction of the lower end 52 of the locking wedge gives the locking wedge its wedge-like diminishing shape.

In order to achieve a locking effect, the coupling device exhibits a support surface for the locking wedge 50 which is formed by a rear, forwards facing tightening surface 53 arranged at the rear portion 54 of the locking body 55 in the through-going cavity 41.

The coupling device also exhibits a third tightening part 56, which is arranged to form a tightening point towards the upright above the gripping part 6 as well while the first tightening part 38 forms a tightening point below the gripping part. In this way, the extreme stiffness of the coupling device in its locked position is assured even though the upper tightening part 56 in principle is not entirely necessary for the basic function. The upper tightening part 56 is an element which is separate from the first lower tightening part 38 in the example shown, but can alternatively form a rigid unit together with the lower tightening part in the form of a U-shaped yoke. In the example shown, the tightening part 56 is pivotably or flexibly connected to the axis pin 39. The third tightening part 56 exhibits a portion which protrudes towards the upright 57, with a forwards facing tightening surface 58. Furthermore, the third tightening part 56 instead of a hole for the axis 39 exhibits a fork-shaped portion 59 with a recess 60 which is open in the rearwards direction. In addition, the third tightening part exhibits a rearwardly facing tightening area 61 which is arranged to be tightened by interaction with a forwards facing sloped tightening surface or wedge surface 62 of the second tightening part 50, which below, for the sake of simplicity, will be referred to as the locking wedge. The locking wedge is also mobile in the vertical direction between a release position shown in FIGS. 2, 4, 9 and 10, and a locking position shown in FIGS. 3, 5, 7 and 8. The locking wedge exhibits an elongate hole 63 through which the shaft 39 extends, and thereby the locking wedge cannot be removed from the coupling device since its area of movement is restricted ty the hole.

Figure 6:
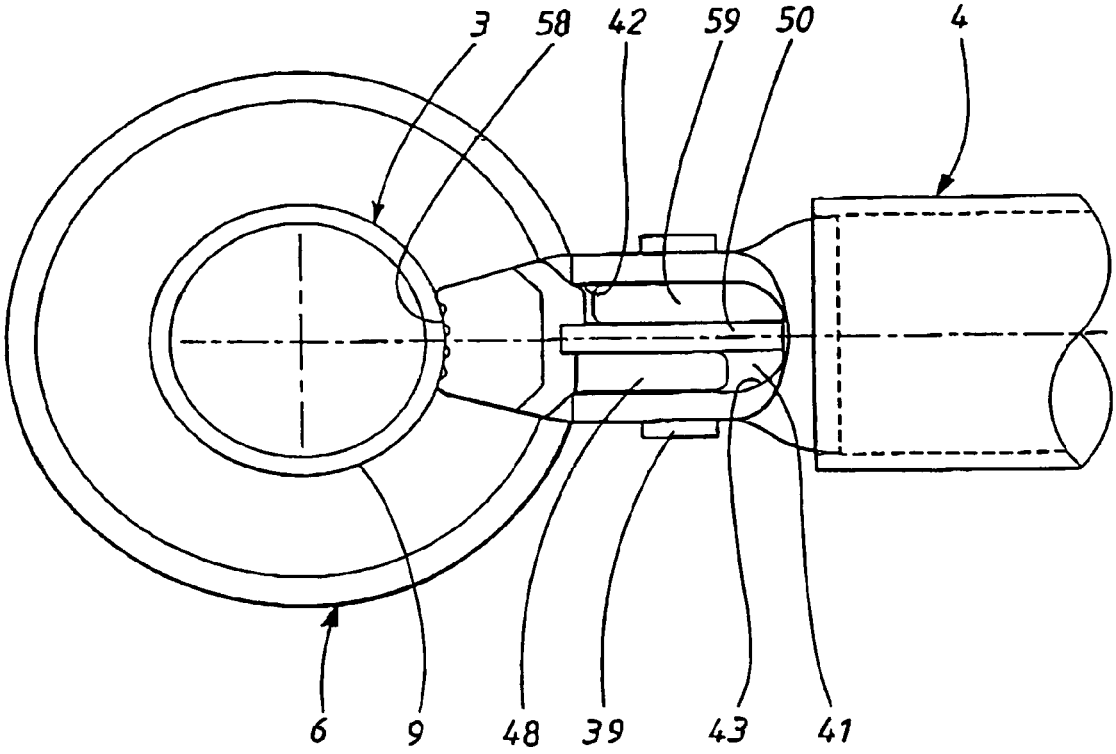
FIG. 6 is a view of the device from below.
Figure 7:
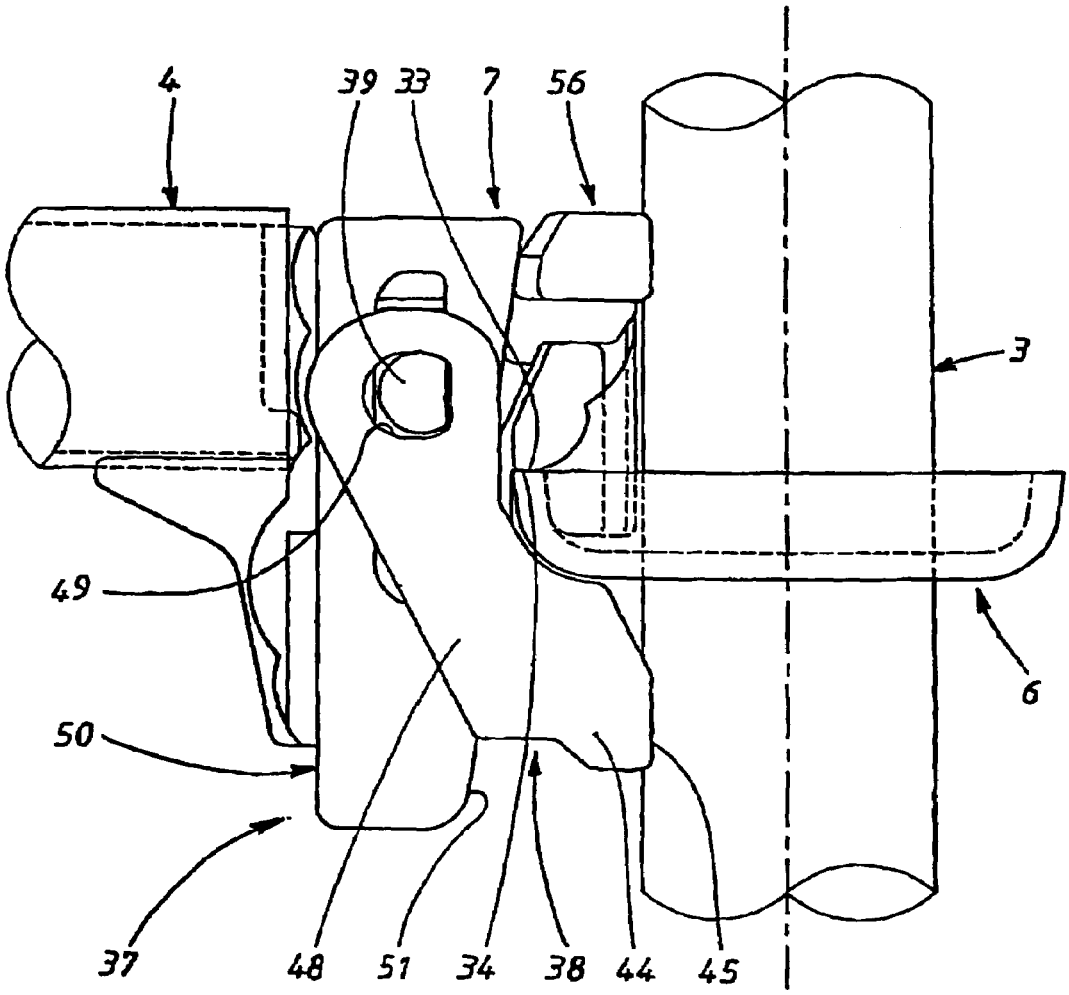
FIGS. 7 and 8 are partial cross-sections of the device in the locked position from either side.
Figure 8:
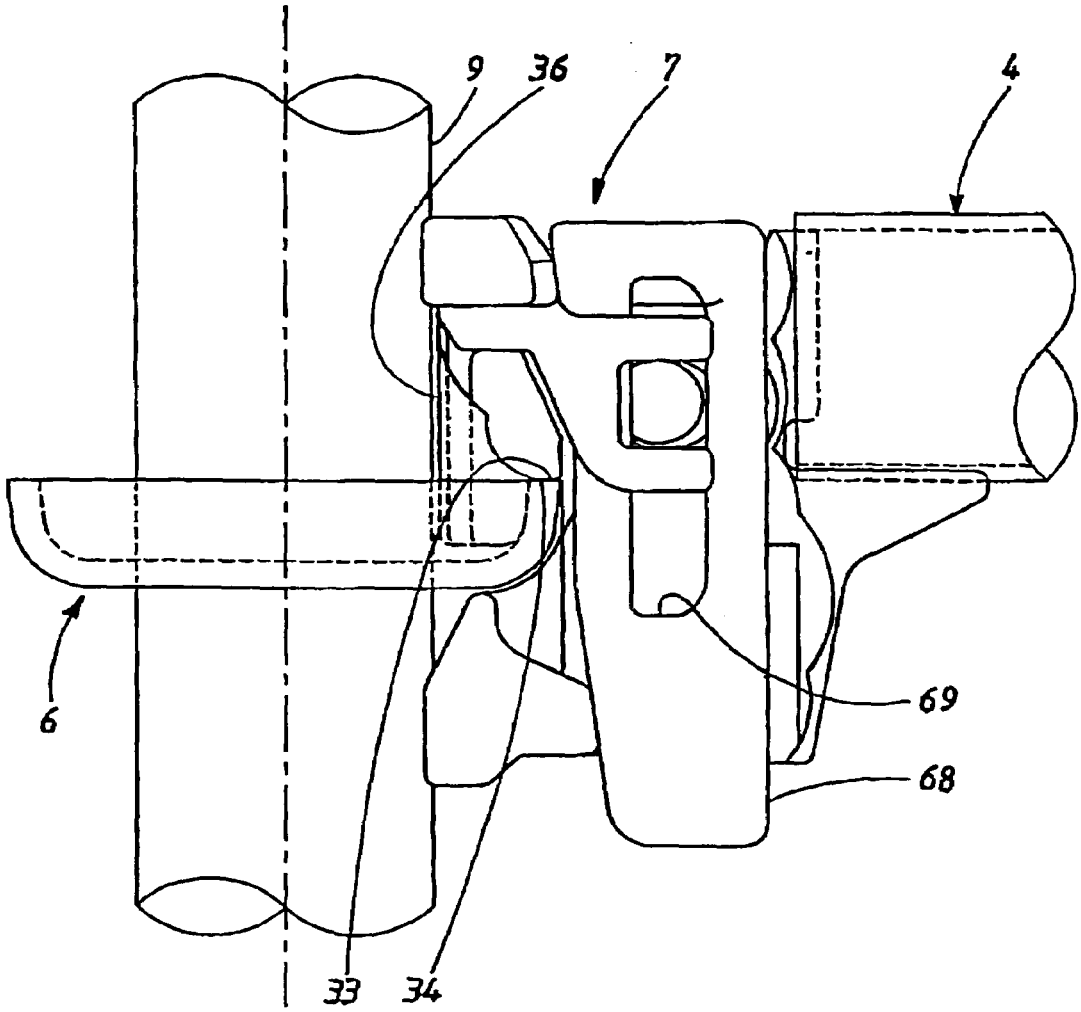
Figure 9:
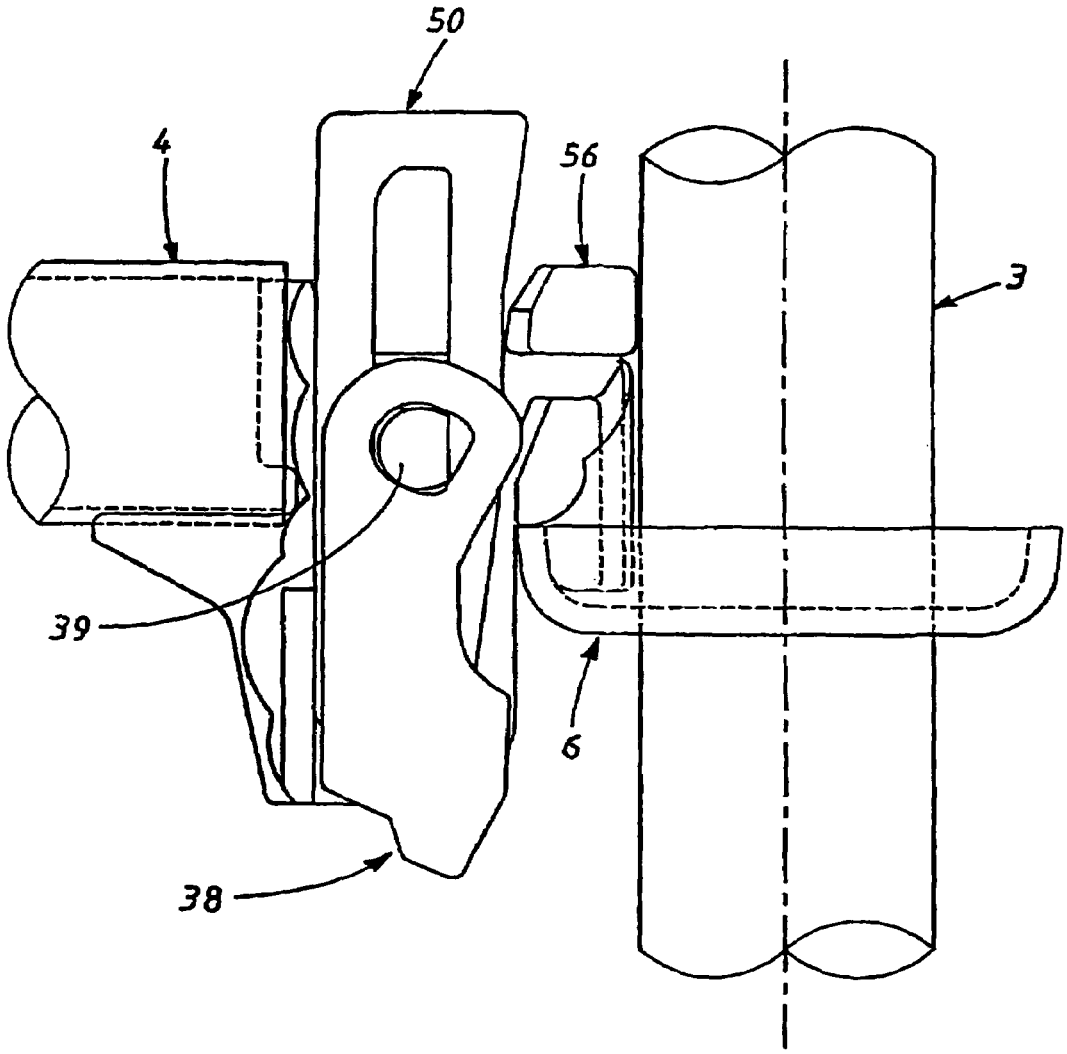

As can be seen in FIG. 6, the first and the third tightening parts are advantageously asymmetrical in their portions in the through-going space 41 in order to thereby save space. Thus, the elongate portion 48 of the first tightening part 38 is arranged on the one side of the locking wedge 50, while the fork-shaped portion 59 of the third tightening part 56 is arranged on the other side of the locking wedge.

Figure 10:
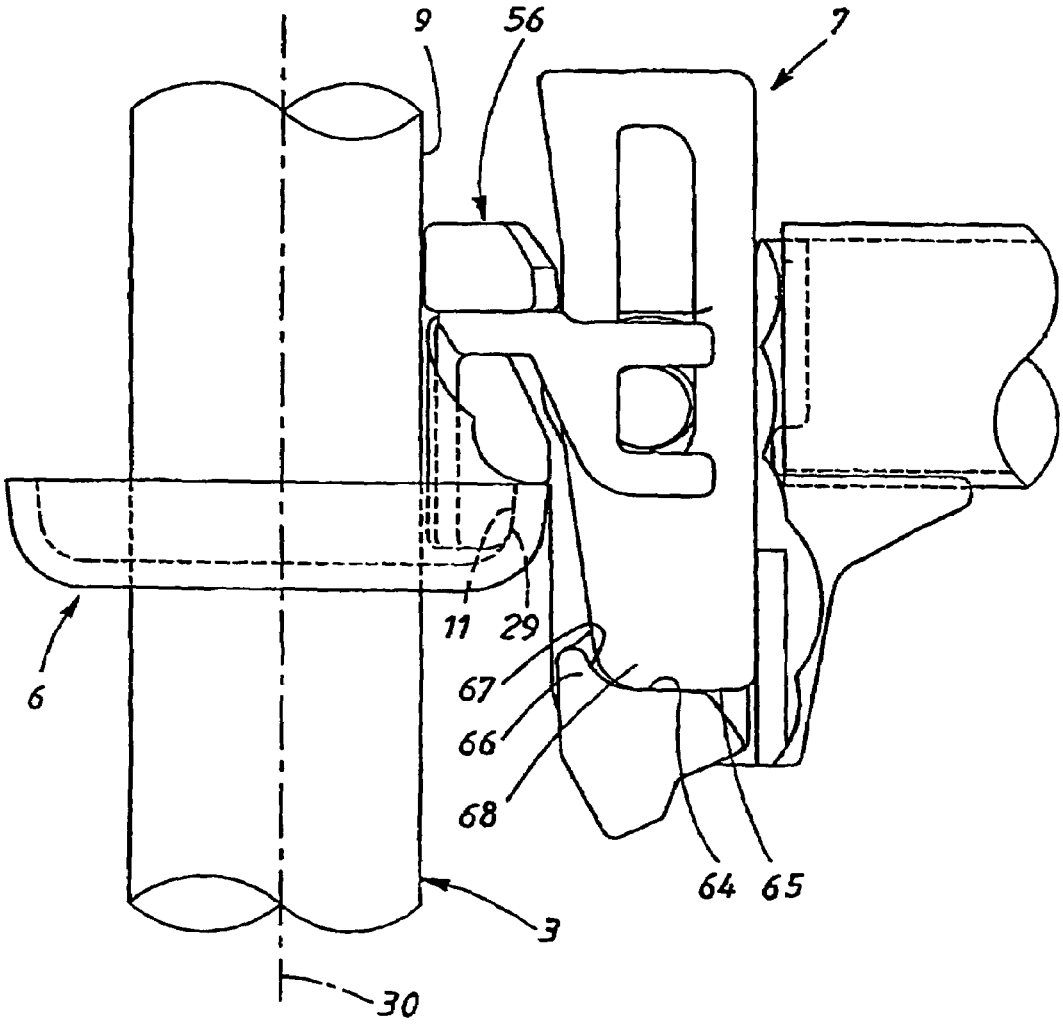
Figure 11:
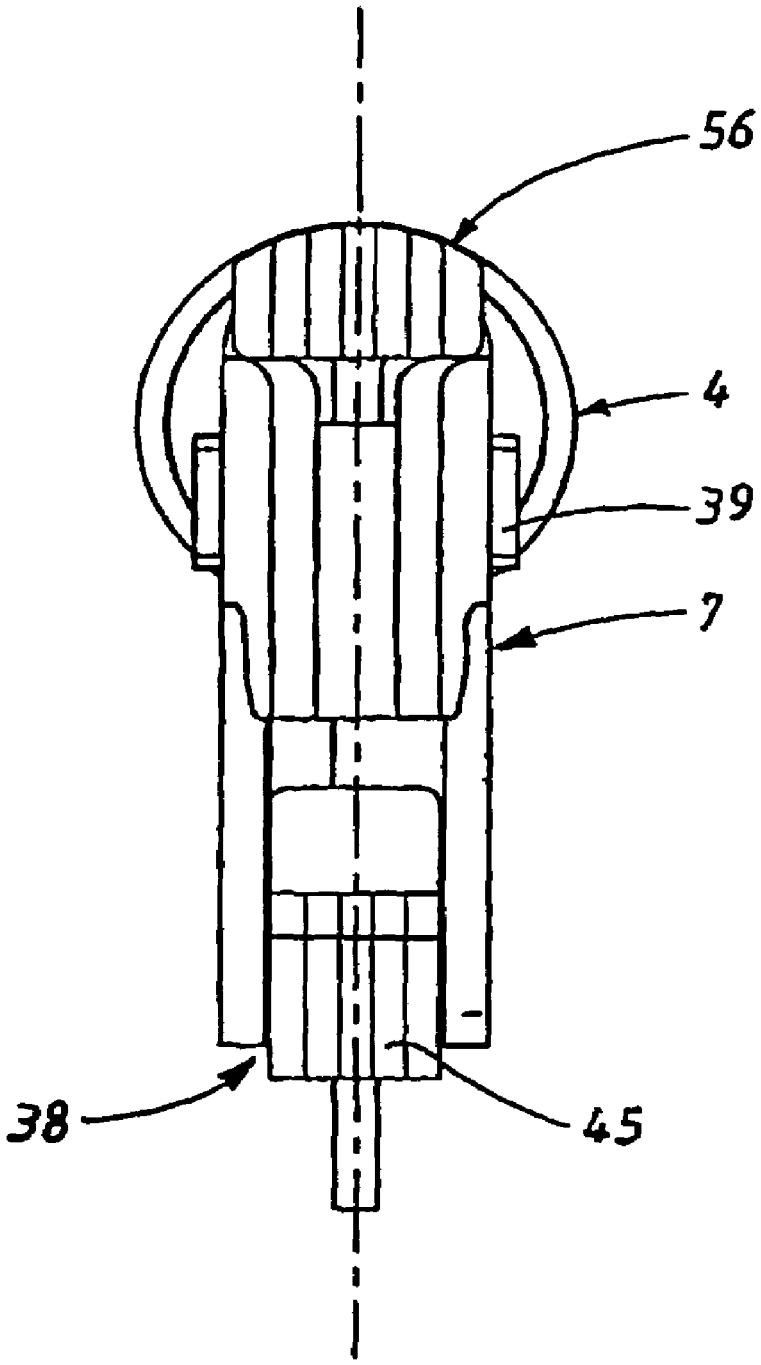
FIG. 11 is a front view of a part of the device with a gripping part of the device not shown for the sake of clarity.

According to the invention, the locking device 37 is arranged to assume a stabile release position, in more detail with the first tightening part 38 arranged so that it strives to assume the release position which position can best be seen in FIGS. 4 and 10, at the same time as it holds the locking wedge 50 in the release position. This is accomplished by a part of the first tightening part 38 being arranged to support the locking wedge 50 in the release position of the locking device. In more detail, the first locking part 38 exhibits an upwardly facing support surface 64 which is arranged to support the locking wedge, in more detail by the locking wedge exhibiting a downwards facing support surface 65, which in the example shown is formed by the downwards facing edge 52 of the locking wedge. The upwards facing supporting surface of the first tightening part is formed by the lower slightly protruding part 44 of the first tightening part. This part 44 is, also due to the above described asymmetry, a sideways-going part, which in the sideways direction protrudes from the elongate portion 48 of the first tightening part. In principle, the first tightening part could alternatively be U-shaped with two elongate portions and with a lower part 44 arranged between them. The upwards facing support surface 64 of the first tightening part 38 is advantageously with its shape adapted to the downwards facing support surface 65 of the locking wedge, and is in the release position advantageously essentially horizontal or extends essentially in a radial plane relative to the longitudinal axis 30 of the upright 3. In front of the supporting surface 64, there is arranged an upwards protruding guiding portion 66 in front of the lower end of the wedge said guiding portion having a guiding surface 67 adapted to the shape of the wedge in the example shown a rounded guiding surface adapted to the rounded corner 68 of the wedge, see FIG. 10.

The first tightening part 38 advantageously has its centre of gravity so that when the sideways scaffolding element is held horizontally or with the hook-shaped part of the coupling device 7 turned upwards it strives to assume its release position. This will become possible if the scaffolding element is at the same time rotated so that the hook-shaped coupling part is held in a reverse position, i.e. with the hook-shaped portion facing upwards so that the locking wedge due to its own weight will fall downwards to its release position, thus enabling the first tightening part 38 to be pivoted to a release position. The locking wedge will then be in a position slightly above its release position, which is made possible by the choice of the length of the elongate hole and its position so that the contact end of the hole 69 will interact with the axis pin 39 when the support surface 65 of the locking wedge is positioned just above the supporting surface 64 of the tightening part 38.

After this, the scaffolding element 4 is rotated about its longitudinal axis, causing the wedge to fall back into contact with the supporting surface of the tightening part 38. Due to some friction between the supporting surface 64 and the supporting surface 65 of the locking wedge, it can be ensured that the tightening part 38 is retained in the release position. Grooves or a similar locking shape can also ensure this retainment. However, the retainment should not necessitate the lifting of the locking wedge 50 in order to move the first tightening part 38 to the locking position.

With the locking device in the release position, the coupling device can be connected since the hook-formed part 7 is entered into the gripping portion 6 and rests in this by means of interaction between the gripping surface 29 of the hook-shaped part 7 and its resting surface 34, and the corresponding gripping surface 11 and resting surface 33 of the gripping part and the contact surface 30 of the hook-shaped part against the enveloping surface 9 of the upright. This position is assured by gravitation giving a continuous vertical force which strives to hold the hook-shaped part in the gripping position. With the locking device in the release position, it is in a corresponding manner simple to separate the coupling parts by lifting the sideways scaffolding elements vertically and to remove the hook-formed part from the gripping part. This coupling position thus holds the sideways scaffolding elements 4, 5 in the scaffolding coupled.

In the coupling position, the locking device is activated by the first tightening part 38 first being rotated to the position shown in FIGS. 3, 5, 7, 8 with the forward facing tightening surface 45 on the first tightening part being contacted to the enveloping surface 9 of the upright. From the figures it will become obvious that the first tightening part is so shaped that it seen from the side extends around the gripping part without contact with it so that exclusively the intended tightening surface 45 will come into contact with the upright. The movement of the first, i.e. the lowered tightening part 38 is done by means by a manual activation suitably by blows using a conventional hand tool against a backwards, downwards facing contact surface 67 of a protruding part of the tightening part 38 protruding below the locking body 40. In so doing the supporting surface 64 for the locking wedge 50 is removed and will thus fall into the locking position, see FIGS. 3, 5, 7, 8. This will also cause the second, i.e. the upper tightening portion 56 into the locking position. This is done more or less due to the weight of the wedge when the first tightening part has been moved away so that the forwards facing tightening surface 62 of the wedge will come into contact with the rearwards facing tightening surface 61 of the second tightening part. A wedge interaction will thus be caused since the wedge obtains support rearwards with its rearwards facing tightening surface 68 in contact with the forwards facing tightening surface 53 of the locking body 48.

Since the various tightening surfaces are not necessarily located in the same radial plane any torques of either the first tightening part or the other tightening part, i.e. the locking wedge is absorbed by means of interaction between the shaft 39 and the attachment of the first and the third locking part in it. For a stabile wedging effect it is necessary that the wedge angle, i.e. the slope of the tightening surfaces 51, 62 cause small vertical forces upwards which are less than the friction forces in the tightening surfaces of the wedge.

The movement of the locking device to a release position is done in an analogous but opposite manner. The wedge 50 is struck out of the locking position by means of a blow from beneath with for example a hand tool against the supporting surface 52 possibly followed by lifting the wedge by hand until it has reached its upper end position. In so doing the first tightening part 38 can swing out due to its own weight so that the supporting surface 64 will be in a position below the supporting surface 52 of the wedge following which the wedge is released downwards towards the supporting surface and will rest stabilly in the release position. The third tightening part 56 is also loose and the locking device is in the release position. The hook-shaped part 7, i.e. the horizontal scaffolding element 4 can thus be lifted out of the gripping part 6.

The invention is not limited to the above described and in the drawings shown embodiments but can be varied within the scope of the appended claims. For example the gripping part can alternatively consist of a disc with a number of through-going holes. It is in principle not necessary with a third tightening part. Alternatively it is possible that the first and the third tightening parts are in one and the same piece.

The invention claimed is:

1. A device for coupling scaffolding elements to uprights in a scaffold, the device having both a gripping part and a hook-shaped part, the gripping part adapted for being connected to the upright and having a first gripping surface which faces the upright and extends at a distance from the upright, the hook-shaped part having at least one second gripping surface which faces away from the upright, the hook-shaped part arranged to be hooked into the gripping part and to be supported by the gripping part by interaction means between the first and the second gripping surfaces, the device having a locking element which is switchable between a locking position and a release position, the device comprising a first tightening part arranged in the hook-shaped part so as to be pivotable about a pivoting axis, a second tightening part, which is shaped as a locking wedge being pivotable about the pivoting axis, the first tightening part and the second tightening part being part of the locking element.

2. The device according to claim 1, wherein the first tightening part includes a protruding portion having a forward tightening surface, a rear tightening surface and a supporting surface.

3. The device according to claim 1, wherein the gripping part includes a first resting surface and the hook-shaped part includes a second resting surface, the first resting surface and the second resting surface adapted to support the hook-shaped part which in the locking position faces downwards, the hook-shaped part being arranged to be supported by interaction between the first and the second resting surface.

4. The device according to claim 2, wherein the second tightening part includes an elongate hole through which the pivoting axis extends.

5. The device according to claim 4, wherein the protruding portion of the first tightening part is arranged to support the second tightening part in the release position.

6. The device according to claim 1, further comprising a third tightening part adapted to be brought against the upright by movement of the second tightening part into the locking position.

7. The device according to claim 6, wherein the third tightening part includes a fork-shaped portion with a recess, the recess positioned about the pivot axis.

8. A device for coupling scaffolding elements to uprights in a scaffold, the device having both a gripping part and a hook-shaped part, the gripping part adapted for being connected to the upright and having a first gripping surface which faces the upright and extends at a distance from the upright, the hook-shaped part having at least one second gripping surface which faces away from the upright, the hook-shaped part arranged to be hooked into the gripping part and to be supported by the gripping part by interaction means between the first and the second gripping surfaces, the device having a locking element which is switchable between a locking position and a release position, the device comprising a first tightening part arranged in the hook-shaped part so as to be pivotable about a pivoting axis, a second tightening part, which is shaped as a locking wedge being pivotable about the pivoting axis, the first tightening part and the second tightening part being part of the locking element;

wherein the first tightening part includes a protruding portion having a forward tightening surface, a rear tightening surface and a supporting surface; and wherein the second tightening part includes an elongate hole through which the pivoting axis extends.

9. The device according to claim 8, wherein the protruding portion of the first tightening part is arranged to support the second tightening part in the release position.

10. A device for coupling scaffolding elements to uprights in a scaffold, the device having both a gripping part and a hook-shaped part, the gripping part adapted for being connected to the upright and having a first gripping surface which faces the upright and extends at a distance from the upright, the hook-shaped part having at least one second gripping surface which faces away from the upright, the hook-shaped part arranged to be hooked into the gripping part and to be supported by the gripping part by interaction means between the first and the second gripping surfaces, the device having a locking element which is switchable between a locking position and a release position, the device comprising a first tightening part arranged in the hook-shaped part so as to be pivotable about a pivoting axis, a second tightening part, which is shaped as a locking wedge being pivotable about the pivoting axis, the first tightening part and the second tightening part being part of the locking element; and a third tightening part adapted to be brought against the upright by movement of the second tightening part into the locking position, wherein the third tightening part includes a fork-shaped portion with a recess, the recess positioned about the pivot axis.

11. A coupling device comprising:

a first tightening part having a tightening surface, said first tightening part moveable about a pivot axis;

a second tightening part moveable about said pivot axis, said first tightening part and said second tightening part translatable between a release position and a lock position, wherein after said first tightening part is moved about said pivot axis and into said lock position, said second tightening part is moveable about said pivot axis into said lock position; and a third tightening part operable between said release position and said lock position, wherein said movement of said second tightening part from said release position to said lock position causes said third tightening part to move from said release position to said lock position;

wherein said third tightening part includes a fork-shaped portion having a recess which is arranged about said pivot axis.

12. The coupling device according to claim 11, wherein said first tightening part includes a first surface and a second surface, said first surface adapted to engage a scaffold when said first tightening part is in said lock position, said second surface engagable with said second tightening part when said first tightening part is in said lock position.

13. The coupling device according to claim 11, further comprising a first resting surface and a second resting surface, said first and second resting surface adapted to engage a portion of a scaffold.

14. The coupling device according to claim 11, wherein said second tightening part is wedge-shaped, further wherein said first tightening part and second tightening part, each include a hole through which said pivot axis extends.

15. The coupling device according to claim 11, wherein said first tightening part includes a protruding portion arranged to underlie said second tightening part when said first and second tightening parts are in said release position.

16. The coupling device according to claim 11, wherein said pivot axis includes a pivot pin.

* * * * *